United States Patent [19]

Iida et al.

[11] 4,170,177

[45] Oct. 9, 1979

[54] PRINTING MACHINE INKING DEVICE WITH PLURALITY OF CAM LEVERS

[75] Inventors: Mitsuhiko Iida, Zama; Yasuo Kato, Yokohama; Kazuyuki Baba, Zama; Hideo Fujie, Shizuoka, all of Japan

[73] Assignee: Toshiba Kikai Kabushiki Kaisha, Tokyo, Japan

[21] Appl. No.: 893,464

[22] Filed: Apr. 4, 1978

[30] Foreign Application Priority Data

| | | | |
|---|---|---|---|
| Apr. 7, 1977 | [JP] | Japan | 52/39826 |
| Apr. 7, 1977 | [JP] | Japan | 52/39827 |
| Apr. 7, 1977 | [JP] | Japan | 52/43369[U] |
| Feb. 6, 1978 | [JP] | Japan | 53/13500[U] |

[51] Int. Cl.[2] ..... B41F 31/04; B41F 31/18

[52] U.S. Cl. ..... 101/365; 101/169

[58] Field of Search ..... 101/365, 157, 169; 118/261, 262; 15/256.5

[56] References Cited

U.S. PATENT DOCUMENTS

| | | | |
|---|---|---|---|
| 2,190,929 | 2/1940 | Behrens | 101/365 |
| 3,696,743 | 10/1972 | Johne et al. | 101/365 |
| 3,820,459 | 6/1974 | Paul | 101/365 |
| 3,822,642 | 7/1974 | Grindeland | 101/169 X |
| 3,855,927 | 12/1974 | Simeth | 101/365 |
| 4,050,380 | 9/1977 | Pfizenmaier | 101/365 |

FOREIGN PATENT DOCUMENTS

| | | | |
|---|---|---|---|
| 1102181 | 3/1961 | Fed. Rep. of Germany | 101/365 |
| 1269138 | 5/1968 | Fed. Rep. of Germany | 101/365 |
| 473562 | 1/1972 | Japan | 101/365 |
| 166710 | 7/1921 | United Kingdom | 101/365 |

*Primary Examiner*—J. Reed Fisher

*Attorney, Agent, or Firm*—Koda and Androlia

[57] ABSTRACT

In an inking device of a printing machine including an inking roller, there are provided a plurality of cam levers disposed side by side and in direct contact with each other along the longitudinal direction of the surface of the inking roller and supported pivotably by a stationary member of the inking device. The cam levers are driven by adjusting means so as to adjust the gap between the surface of the inking roller and the surface of the cam levers.

3 Claims, 7 Drawing Figures

PRINTING MACHINE INKING DEVICE WITH PLURALITY OF CAM LEVERS

BACKGROUND OF THE INVENTION

This invention relates to an improvement of the inking device of a printing machine and more particularly adjusting means for the amount of ink to be used.

FIG. 1 shows a conventional inking device of a printing machine, in which there is disposed a support 3 for supporting, through a mounting block 4, a doctor knife 2, one edge of which is positioned closely to the outer peripheral surface of an inking roller 1. The mounting block 4 is mounted on the support 3 by a plurality of bolts, not shown, and is fixed integrally to the doctor knife 2. A plurality of cam levers 5 are pivotally connected to the support 3 by pins 6 and the top surfaces of the cam levers 5 contact the doctor knife 2 to adjust the gap between the doctor knife 2 and the inking roller 1. The front ends of adjusting screws 7 screwed through the support 3 abut against the back surfaces of the cam levers 5 respectively so as to slightly rotate the cam levers by rotating the screws 7.

Accordingly, in the case where it is required to adjust the amount of the ink to be used, an operator had to rotate the adjusting screws 7 to rotate clockwisely or anti-clockwisely the cam levers 5 about the pins 6 thereby slightly approaching or separating the front edge of the doctor knife to and from the inking roller 1, whereby the gap therebetween can be adjusted.

However, with the conventional construction described above, the amount of the ink in the inking device to be used had to be adjusted manually by controlling the adjusting screws 7, and moreover, the operator could not judge whether a suitable amount of ink was applied on a printing matter or not until the printed matter reaches a collecting portion of the printed matters where the operator can inspect them. If the ink amount was not suitable for the printed matter, the operator had to readjust the adjusting screw. Thus, in the conventional inking device of a printing machine, the adjustment of the ink involved much time, and labour of the operator and loss of printed matters.

Furthermore, since the doctor knife 2 is made of a thin plate, the doctor knife 2 is often deformed by the rotation of the inking roller 1 and the viscosity of the ink 14, thereby changing the gap between the knife 2 and the roller 1. This affects adversely printed matters.

SUMMARY OF THE INVENTION

Accordingly, an object of this invention is to remove the defects in the prior art inking device of a printing machine.

Another object of this invention is to provide an improved inking device of a printing machine wherein a desired amount of ink can be properly fed without being affected by the viscosity of the ink and the peripheral speed of the inking roller.

A further object of this invention is to provide an improved inking device comprising a rocking mechanism capable of being rocked by adjusting means so as to adjust the gap between the inking roller and the rocking mechanism.

According to the present invention, there is provided an inking device of a printing machine including an inking roller. The inking device comprises a plurality of cam levers disposed side by side and in direct contact with each other along the longitudinal direction of the surface of the inking roller and supported pivotably by a stationary member of the inking device, and a mechanism for driving the cam levers so as to adjust the gap between the surface of the inking roller and the surface of the cam levers.

The other objects and advantages of this invention will become apparent from the following description made in conjunction with the accompanying drawings.

DESCRIPTION OF THE PREFERRED EMBODIMENTS

Figure 1:
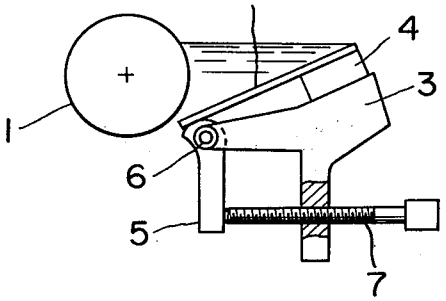
FIG. 1 PRIOR ART
FIG. 1 is a schematic side view showing a conventional inking device of a printing machine.
Figure 2:
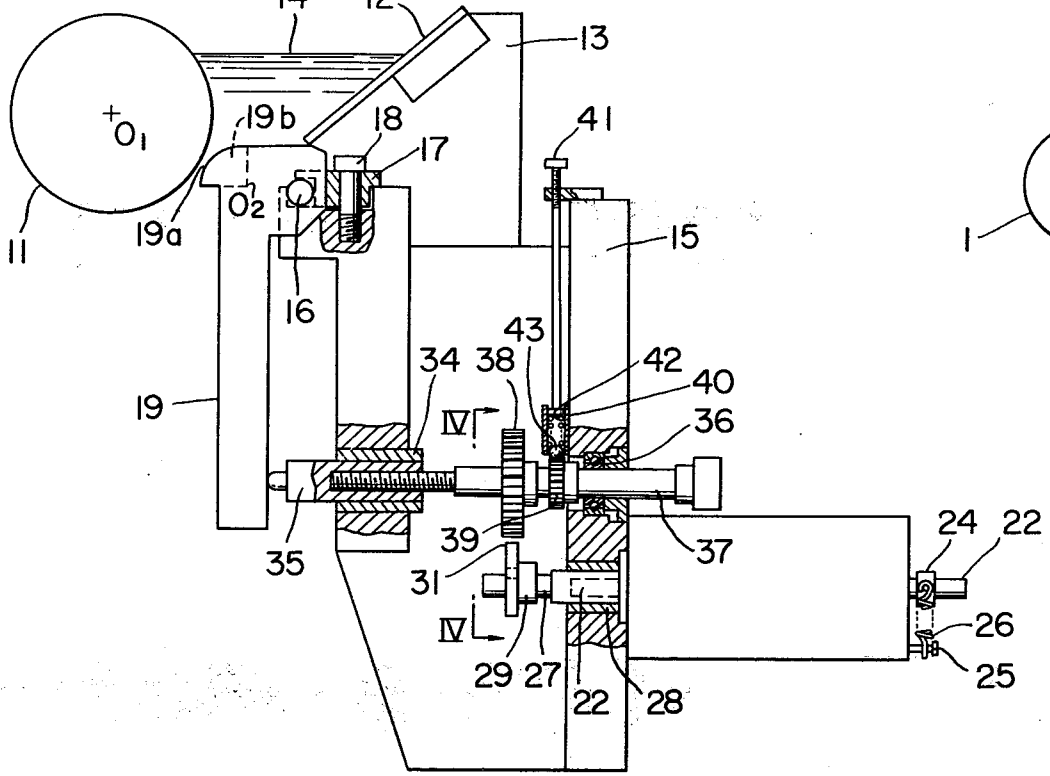
FIG. 2 is a schematic side view, partially in section, showing an inking device according to this invention.

FIG. 2 shows one embodiment of the inking device of this invention, in which an inking roller 11 is rotatably supported by bearings, not shown, at both ends of the roller 11 and rotated by a driving source, not shown. A mounting member 13 is located along the surface of the inking roller 11 and has a length equal to or larger than the whole longitudinal length thereof, and an ink reservoir for storing ink 14 is defined by the inking roller 11, a leakage preventing plate 12 fixed to the mounting member 13 and side plates, not shown. A pin 16 is attached to a support member 15 fixed to the mounting member 13 by means of press member 17 and a bolt 18, and the pin 16 engages and supports a cam lever 19 in a pivotable manner. The cam lever 19 is provided with a curved surface 19*a* closely opposite to the peripheral surface of the inking roller 11. Thus, the amount of ink passing through the gap between the roller 11 and the curved surface 19*a* of the cam lever 19 can be adjusted by rotating the cam lever 19.

In the inking device described above, a plurality of cam levers 19, each having a considerably narrow width, are disposed side by side and in direct contact with each other along the longitudinal direction (vertical direction to the drawing) of the inking roller 11. The reason why such a plurality of cam levers are used to one inking device is that it is generally required that the tone of color of the ink applied to a printing paper should be different along the longitudinal axis of the roller 11. Thus, the gaps between the inking roller 11 and the cam levers 19 are adjusted respectively by rotating independently the cam levers 19, and the ink passing through the gaps can thus be controlled.

Figure 3:
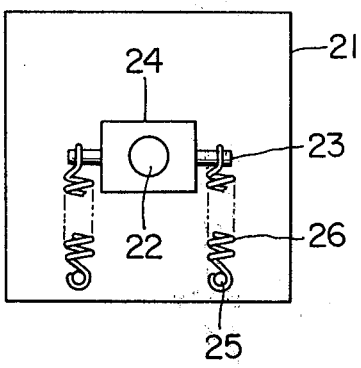
FIG. 3 is a side view showing a portion of the inking device shown in FIG. 2.

On the one side of the support member 15 there is fixed the stationary portion of a rotary solenoid 21 which is rotated by about 30° in a desired direction when the solenoid is operated in a manner described hereinafter. A return controlling member 24 is fixed to the rear end of the shaft 22 of the rotary solenoid 21, and a cross pin 23 is used to connect the member 24 to the shaft 22 as shown in FIG. 3. Spring means 26 are connected between the both ends of the pin 23 and a pair of pins 25 secured to the end surface of the rotary solenoid 21, so that when the solenoid is energized, the shaft 22 is rotated in the clockwise or anti-clockwise direction, and returns to the original position shown in FIG. 3 when the solenoid is deenergized.

Figure 4:
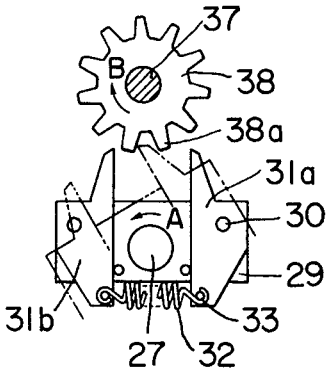
FIG. 4 is a cross sectional view taken along the line IV—IV in FIG. 2.

A rotary shaft 27 is secured to the front end of the shaft 22 of the rotary solenoid 21 and supported by the support member 15 through a bearing 28. A plate 29 for attaching pawl means is secured to the rotary shaft 27 in a manner shown in FIG. 4. As shown in FIG. 4, a pair of pawls 31 (31*a*, 31*b*) are pivotally connected to the plate 29 by pins 30, and the lower portions of the pawls 31 are always urged inwardly by spring means 32, but the inward movements thereof are limited by pins 33. The pins 33 also check the opening of the pawls 31 in the case where a force is applied to the upper portions of the pawls to open them.

Stop members 35 are fitted to the support member 15 for the corresponding cam levers 19 on the left-hand side of the member 15 as viewed in FIG. 2 and the rotation of this stop member 35 is prevented by means of a key, not shown, attached to the support member, but the axial movement thereof is permitted by a bearing 34. The front end of each stop member 35 abuts against the cam lever 19 and the rear end thereof is provided with an internal thread which is engaged with an external thread of a driving shaft 37. The driving shaft 37 is supported to be rotatable but not axially movable by means of a bearing 36. A ratchet wheel 38 is mounted on the driving shaft 37 opposite to the pawls. Of course, a plurality of stop members 35 are disposed to abut against the cam levers 19, respectively.

Furthermore, a toothed wheel 39 is also mounted on the driving shaft 37 behind the ratchet wheel 38, and a ball 43 housed in a holder 40 is urged to engage the valley of the toothed wheel 39 by a spring 42, the force of which is variable by an adjusting shaft 41 so as to prevent the shaft 37 from moving backwardly when the rotary solenoid 21 is deenergized and moved to the original position. Further, it is possible to use a disc member having depressions which are engageable with the ball 43. The wheel 39 may be eliminated by arranging the ball to engage the pawls 31 or the wheel 38.

A driving mechanism of the rotary solenoid 21 used in this invention comprises a plate-like rotor and two pairs of electromagnets for the forward and rearward rotations of the rotor. The axes of each pair of magnets cross the longitudinal axis of the rotor at an angle of about 30°. When either one of the magnet pairs is energized by a known circuit, the rotor is rotated by about 30° and when the magnets are deenergized, the rotor is returned to the original position by the spring means 26. Thus, by the operation of the rotary solenoid 21 the shaft 22 (i.e. shaft 27) is moved backwardly and forwardly to rotate the cam lever 19.

The operation of the inking device shown in FIG. 2 will be described hereunder.

When a signal is applied from an operation center to a clock pulse generation circuit, not shown, the shaft 22 of the rotary solenoid 21 is rotated by the signal by about 30° in the forward or rearward direction. For convenience's sake, it is now assumed that the shaft 22 is rotated by 30° in the direction shown by an arrow A in FIG. 4. Thus, when the shaft 22 (i.e. shaft 27) is rotated, the plate 29 attached with a pair of pawls 31 is rotated in the same direction, and at this time, the right hand pawl 31*a* engages the tooth 38*a* of the wheel 38 and rotates it in a direction shown by an arrow B, thus displacing it through about one pitch of the tooth. In accordance with the rotation of the wheel 38, the driving shaft 37 is also rotated, and the rotation of the shaft 37 is transmitted to the stop member 35 and advances it to push and rotate the cam lever 19 forwardly (clockwisely). This clockwise rotation of the cam lever 19 decreases the width of the gap between the inking roller 11 and the curved surface 19*a* of the cam lever 19 thereby reducing the flow amount of the ink through the gap. When the shaft 22 (shaft 27) of the rotary solenoid 21 is reversely rotated, the pawl 31*b* engages with the tooth 38*a* of the wheel 38 and rotates the shaft 37 reversely. Therefore, the stop member 35 is moved rearwardly and the cam lever 19 is rotated anti-clockwisely, whereby the gap between the inking roller 11 and the cam lever 19 is widened and the flow amount of the ink through the gap is increased.

When the rotary solenoid 21 deenergized, the shaft 22 returns to the original position shown in FIG. 3 by the spring means 26 and at the same time, the plate 29 is also rotated clockwisely and returned to its original position (shown by a solid line in FIG. 4), but the pawl 31*a* pivotably attached to the plate 29 and engaging with the tooth 38*a* (as shown phantom lines) is rotated anti-clockwisely to disengage therefrom. After the disengagement, the pawl 31*a* is returned to its original position by the spring means 32.

When the pawl 31*a* rotates anti-clockwisely and disengages from the tooth 38*a* of the wheel 38, the wheel 38 is urged to rotate in the direction shown by the arrow A (anti-clockwisely), but since the ball 43 urged by the spring 42 abuts against the tooth of the wheel 39 mounted to the shaft 37, the wheel 38 (i.e. shaft 37) is not returned. Further, when the rotary solenoid 21 is energized, the driving shaft 37, i.e. the wheel 39, can be rotated freely because the ball 43 is forced upwardly against the force of the spring 42.

Figure 5:
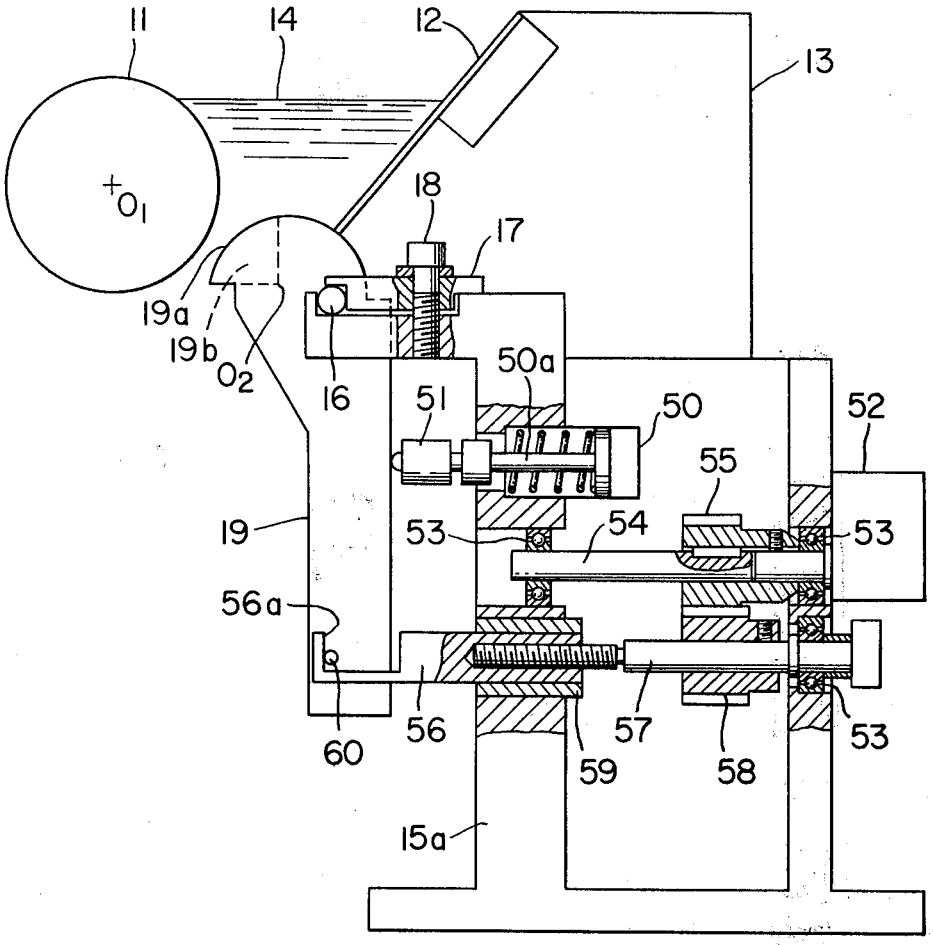
FIG. 5 is a schematic view, partially in section, showing another embodiment of the inking device according to this invention.

FIG. 5 shows another embodiment of the inking device according to this invention, in which same reference numerals are used in FIGS. 2 through 4 are applied to the like parts.

In the illustrated embodiment, an air cylinder 50 is secured to the vertical portion 15*a* of the support member 15 and a stop member 51 is mounted to the free end of the piston rod 50*a* of the cylinder 50. The tip of the stop member 51 normally abuts against the cam lever 19 so that the lever is not moved rearwardly by the pressure of the ink applied on the curved surface 19*a* of the cam lever 19 when the ink flows through the gap between the cam lever 19 and the inking roller 11. Further, a hydraulic cylinder may be used in place of the air cylinder.

A reversible electric motor 52, such as a pulse motor or a stepping motor, is mounted on the right side (as viewed in FIG. 5) of the support member 15, and the output shaft of the motor 52 is connected through a gear 55 to a shaft 54 supported by a bearing 53 mounted on the support member 15. The gear 55 engages with a gear 58 mounted on a shaft 57, one end of which is supported by the bearing 53 and the other end of which is screwed into the internal threads of a stop member 56. The stop member 56 is held against rotation by a key, not shown, but is axially movable, and a notch 56*a* is provided for the front end of the stop member 56 for loosely receiving a pin 60 attached to the cam lever 19.

The operation of the inking device shown in FIG. 5 will be described hereunder.

At first, when air acting on the air cylinder 50 is released, and the piston rod 50*a* (i.e. stop member 51) moves rightwardly (in FIG. 5), the cam lever 19 is rotated anti-clockwisely by the pressure of the ink applied on the curved surface 19*a* of the cam lever 19. At this time, the engagement of the pin 60 with the notch 56*a* of the stop member 56 does not hinder the anti-clockwise rotation of the cam lever. Then, instructions are given to the motor 52 to move the stop member from the present position to a next set position, and according to the instructions the stop member 56 is moved rightwardly or leftwardly and stopped at the next predetermined position. Thereafter, when the air is again supplied to the air cylinder 50, the cam lever 19 rotates clockwisely and stops at the predetermined position when the pin 60 on the cam lever 19 engages with the notch 56*a* of the stop member 56.

In the embodiment illustrated in FIG. 5, since there are also provided a plurality of cam levers 19 each of which has a narrow width along the surface of the inking roller 11, a plurality of motors are also needed. Therefore, the size of the motor is small and the output thereof is also small. However, any appreciable load is not applied to the motor 52 because the motor 52 is merely rotated in accordance with the positional difference between the present position and the next set position of the cam lever 19, and since the output of the motor 52 is merely utilized for overcoming the frictional force of the stop member 56 or the shaft 57, a motor having a small output is sufficient.

Figure 6:
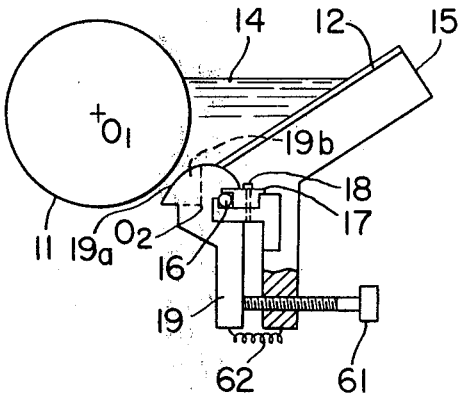
FIG. 6 is a schematic view, partially in section, showing a further embodiment of the inking device according to this invention.

FIG. 6 shows a further modified embodiment of this invention, in which the same reference numerals as used in FIGS. 2 and 5 are applied to the like members.

In this embodiment, an adjusting screw 61 is screwed into the lower portion of a support member 15 and the front end of the screw abuts against the lower portion of the cam lever 19. There is provided spring means 62 having one end attached to the lower end of the cam lever 19 and the other end secured to the lower end of the support member 15. The gap between the curved surface 19*a* of the cam lever and the peripheral surface of the inking roller 11 is narrowed by rotating the adjusting screw 61 in a direction to rotate the cam lever clockwisely, whereas the gap therebetween is widened by the action of the spring means 62 when the screw is loosened. Thus, the amount of the ink flowing through the gap can be adjusted.

Of course, in this embodiment a plurality of cam levers are disposed side by side along the longitudinal direction of the inking roller, and the adjusting screws 61 and the spring means 62 are provided for respective cam levers.

Furthermore, in the embodiments shown in FIGS. 2, 5 and 6, the cam lever 19 may be provided with a segmental tip 19*b* as shown by a dotted line in these Figs., and in the case where such a tip is provided, if the curved portion 19*a* of the cam lever wore out by friction, only the tip 19*b* can be changed and it is not necessary to change the cam lever 19 itself.

Figure 7:
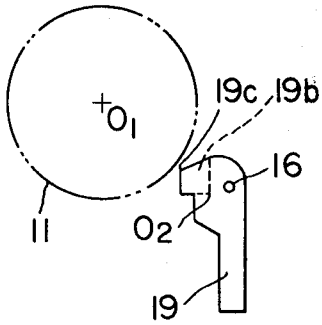
FIG. 7 shows a modification of a cam lever used in this invention.

In this connection, FIG. 7 shows a modification of the cam lever 19 which is provided with a rectangular tip 19*b*, and where such a tip is used, ink passes through the gap between the surface of the inking roller 11 and the corner 19*c* of the rectangular tip 19*b* provided for the cam lever and in the case where such a tip is provided, it is necessary to position the pivot center $O_2$ of the tip below the line joining the center $O_1$ of the inking roller 11 and the pivot pin 16 for the cam lever 19.

Furthermore, the other tip may be applied if the tip has an acute edge opposing the surface of the inking roller 11 regardless the shape of the tip (such as poligonal shape).

As is clear from the foregoing descriptions, according to the present invention, the amount of the ink flowing through the gap between the surface of the inking roller and the surface of the cam lever can be controlled locally by indivisually adjusting the cam levers, and it is not necessary to use a doctor knife as in the prior art inking device.

What is claimed is:

1. An inking device of a printing machine comprising an inking roller, a plurality of cam levers disposed side by side and in contact with each other in the longitudinal direction of said inking roller, said cam levers being pivotably supported by a stationary member of said inking device, and a plurality of means for individually driving said cam levers so as to adjust the gap between the surface of said inking roller and the surfaces of said cam levers, each of said cam levers being made of a solid material and each of said driving means comprising an adjustable stop member provided with a notch at one end to receive a pin secured to the lower portion of each of said cam levers to control angular position thereof, means for adjusting said stop member, and a piston-cylinder assembly for rotating each of said cam levers.

2. The inking device according to claim 1 wherein each of said cam levers is provided with a changeable tip at the portion opposing the surface of said inking roller.

3. The inking device according to claim 2 wherein each said tip is arcuate in cross section.

* * * * *